US010500450B2

(12) United States Patent
Motokawa

(10) Patent No.: US 10,500,450 B2
(45) Date of Patent: Dec. 10, 2019

(54) GOLF CLUB HEAD

(71) Applicant: SUMITOMO RUBBER INDUSTRIES, LTD., Kobe-shi, Hyogo (JP)

(72) Inventor: Yuki Motokawa, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/040,974

(22) Filed: Jul. 20, 2018

(65) Prior Publication Data

US 2018/0345095 A1 Dec. 6, 2018

Related U.S. Application Data

(63) Continuation of application No. 15/336,441, filed on Oct. 27, 2016, now Pat. No. 10,035,050.

(51) Int. Cl.
*A63B 53/08* (2015.01)
*A63B 53/04* (2015.01)

(52) U.S. Cl.
CPC ..... *A63B 53/0466* (2013.01); *A63B 53/04* (2013.01); *A63B 53/08* (2013.01); *A63B 2053/0408* (2013.01); *A63B 2053/0433* (2013.01); *A63B 2053/0437* (2013.01); *A63B 2209/00* (2013.01)

(58) Field of Classification Search
CPC .... A63B 2053/0437; A63B 2053/0433; A63B 2053/0408; A63B 53/0466; A63B 53/08
USPC ..... 473/343, 344, 345, 348, 349
See application file for complete search history.

(56) References Cited

U.S. PATENT DOCUMENTS

| | | | | |
|---|---|---|---|---|
| 7,507,168 | B2 * | 3/2009 | Chou | A63B 53/0466 473/346 |
| 8,025,591 | B2 | 9/2011 | De La Cruz et al. | |
| 2003/0125127 | A1 | 7/2003 | Nakahara et al. | |
| 2007/0099727 | A1 | 5/2007 | Sugimoto | |
| 2007/0105657 | A1 * | 5/2007 | Hirano | A63B 53/04 473/345 |
| 2007/0191133 | A1 * | 8/2007 | Lai | A63B 60/54 473/305 |

(Continued)

FOREIGN PATENT DOCUMENTS

| | | |
|---|---|---|
| JP | 6-121847 A | 5/1994 |
| JP | 10-151698 A | 6/1998 |

(Continued)

OTHER PUBLICATIONS

Japanese Office Action dated Nov. 27, 2018, for corresponding Japanese Patent Application No. 2015-211392, with an English translation.

*Primary Examiner* — Benjamin Layno
(74) *Attorney, Agent, or Firm* — Birch, Stewart, Kolasch & Birch LLP

(57) ABSTRACT

A head 2 includes a face 4, a crown 6, and a sole 8. At least a part of the crown 6 and/or at least a part of the sole 8 is formed by a clad material. The clad material is joined to an adjacent portion brought into contact with a peripheral edge of the clad material. The clad material includes a first layer s1 and a second layer s2. The first layer s1 is the outermost layer. The first layer s1 is welded to the adjacent portion. The second layer s2 does not have an affinity for welding with the adjacent portion.

20 Claims, 10 Drawing Sheets

(56) References Cited

U.S. PATENT DOCUMENTS

| | | | | |
|---|---|---|---|---|
| 2008/0214322 | A1 | 9/2008 | Chou et al. | |
| 2014/0080631 | A1* | 3/2014 | Deshmukh | A63B 53/0466 473/342 |

FOREIGN PATENT DOCUMENTS

| | | | | | |
|---|---|---|---|---|---|
| JP | 2001-598 | A | | 1/2001 | |
| JP | 02002000598 | A | * | 1/2001 | A63B 53/04 |

* cited by examiner

GOLF CLUB HEAD

This application is a continuation of U.S. application Ser. No. 15/336,441, filed on Oct. 27, 2016, now U.S. Pat. No. 10,035,050, which claims the benefit of priority pursuant to 35 U.S.C. § 119(a) to Japanese Patent Application No. 2015-211392, filed on Oct. 28, 2015. The entire contents of the above applications are hereby incorporated by reference.

BACKGROUND OF THE INVENTION

Field of the Invention

The present invention relates to a golf club head. Specifically, the present invention relates to a golf club head in which different types of materials are combined.

Description of the Related Art

A coefficient of restitution and a volume of a head are regulated by the rule. In light of a swing balance, a weight of a head is restricted. The regulation and the restriction complicate the design of a head having enhanced performance.

In order to overcome the regulation and the restriction, a golf club head in which different types of materials are combined has been known. A degree of freedom of the design of a head can be enhanced by a combination of different types of materials. For example, a combination of materials having a specific gravity different from each other can enhance a degree of freedom of the design for a position of the center of gravity of the head.

Japanese Patent No. 3885023 (US2003/0125127) discloses a head in which a hole is provided on a crown part of a head body, and the hole is closed with a cover member made of a material different from a material of the head body. The cover member has a specific gravity smaller than a specific gravity of the head body. Specifically, the specific gravity of the head is equal to or greater than 1.3 times the specific gravity of the cover member. In the head, a flange is formed at a peripheral edge of the crown part, a peripheral edge portion of the cover member is divided into two layers, and the flange is sandwiched by the two divided layers.

SUMMARY OF THE INVENTION

In the case where different types of materials are combined, these materials need to be joined to each other. In view of the use for a club head, a great durability is required for the joining. In light of durability, in the above mentioned conventional technique, the peripheral edge part of the cover member is divided into two layers, and the flange of the head body is sandwiched by the two layers.

In this joining structure of the conventional technique, the two layers of the cover member and the flange of the head body are overlapped with each other. In this structure, a weight of the joining portion is great. The great weight at the joining portion lessens a weight reduction effect brought by a cover member having a low specific gravity.

It is an object of the present invention to provide a golf club head in which different types of materials are combined and a joining portion can be lightweight.

A preferable golf club head according to the present invention includes a crown, a sole, and a face. At least a part of the crown and/or at least a part of the sole are/is formed by a clad material. The clad material is joined to an adjacent portion brought into contact with a peripheral edge of the clad material. The clad material includes a first layer and a second layer. The first layer is the outermost layer. The first layer is welded to the adjacent portion. The second layer does not have an affinity for welding with the adjacent portion. Preferably, the head further includes a hollow part.

Preferably, the second layer fronts on the hollow part.

Preferably, the first layer has a thickness smaller than a thickness of the second layer.

Preferably, at least a part of the crown is formed by the clad material. Preferably, the second layer has a specific gravity smaller than a specific gravity of the first layer.

Preferably, the first layer has a thickness of equal to or greater than 0.1 mm but equal to or less than 0.45 mm. Preferably, the second layer has a thickness of equal to or greater than 0.35 mm but equal to or less than 0.7 mm.

Preferably, the first layer has a thickness of equal to or greater than 0.1 mm but equal to or less than 0.3 mm. Preferably, the second layer has a thickness of equal to or greater than 0.4 mm but equal to or less than 0.6 mm.

Preferably, the clad material has a thickness of equal to or less than 0.7 mm.

Preferably, the clad material has a specific gravity of equal to or greater than 2 but equal to or less than 3.5.

Preferably, the first layer has a specific gravity of equal to or greater than 3.5 but equal to or less than 5.0. Preferably, the second layer has a specific gravity of equal to or greater than 1.6 but less than 3.5.

Preferably, the second layer is made of an aluminum-based alloy or a magnesium-based alloy.

Preferably, at least a part of the sole is formed by the clad material. Preferably, the specific gravity of the second layer is greater than the specific gravity of the first layer.

Preferably, the first layer is made of a titanium-based alloy or a pure titanium. Preferably, the adjacent portion is made of a titanium-based alloy.

DESCRIPTION OF THE PREFERRED EMBODIMENTS

The present invention will be described later in detail based on preferred embodiments with appropriate reference to the drawings.

Figure 1:
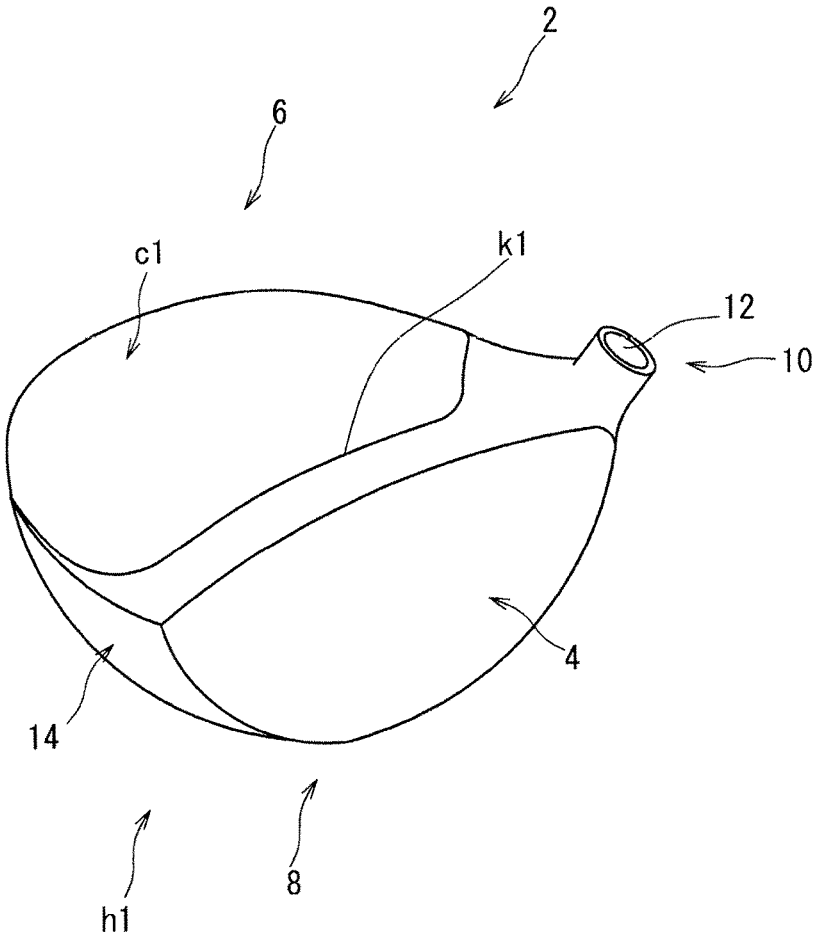
FIG. 1 shows a perspective view of a head according to a first embodiment.
Figure 2:
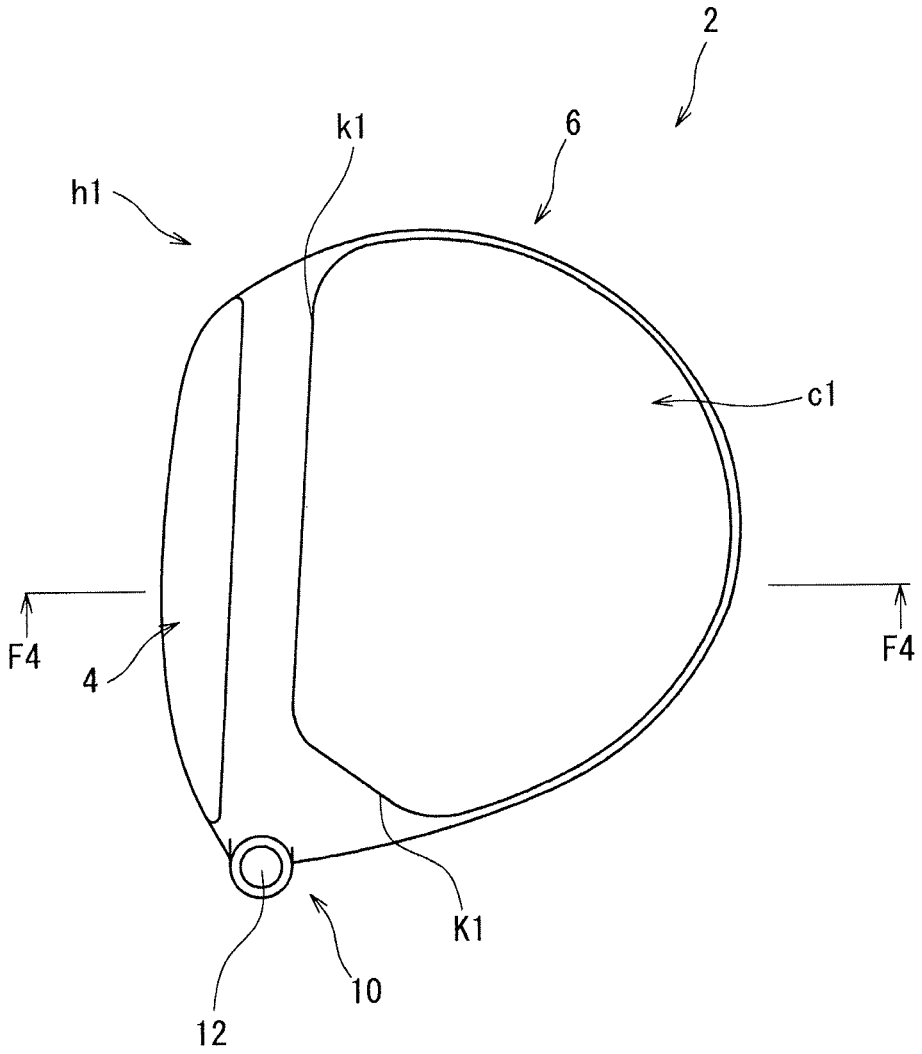
FIG. 2 shows a plan view of the head in FIG. 1.

FIG. 1 is a perspective view of a head 2 according to a first embodiment of the present invention. FIG. 2 is a plan view of the head 2. The head 2 is a wood-type head. The head 2 includes a face 4, a crown 6, a sole 8, and a hosel 10. The hosel 10 includes a shaft hole 12. Inside of the head 2 is hollow. That is, the head 2 has a hollow part. The head 2 further includes a skirt 14.

The head 2 is formed by joining a plurality of members. In the head 2 of the present embodiment, a crown member c1 is joined to a head body h1.

Figure 3:
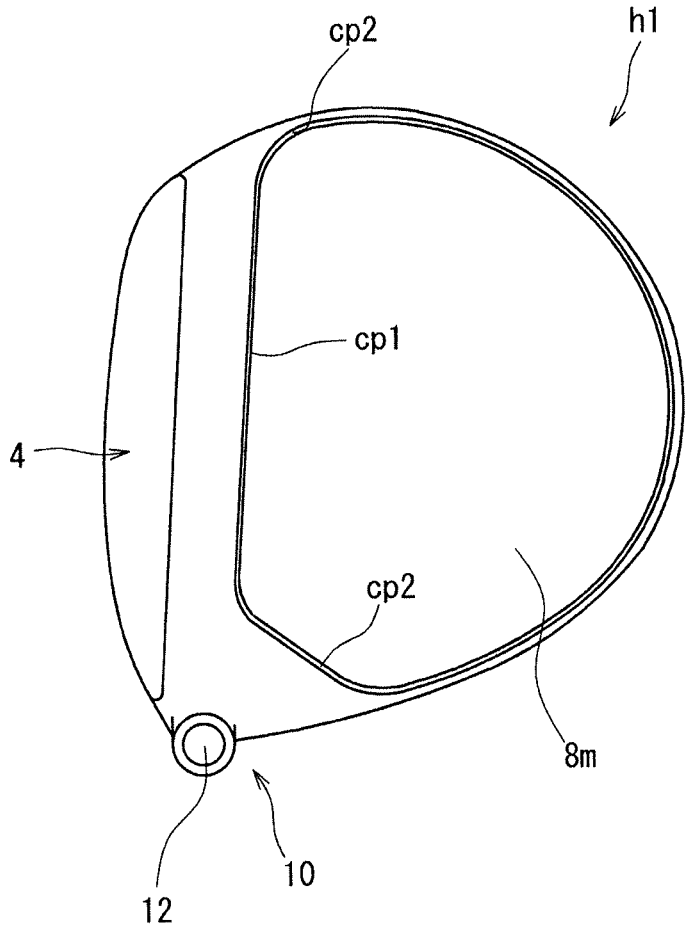
FIG. 3 shows a plan view of a head body of the head in FIG. 1.

FIG. 3 is a plan view of the head body h1 viewed from the crown side. FIG. 3 is a drawing showing the head body h1 alone. The head body h1 includes the whole face 4. The head body h1 includes the whole sole 8. The head body h1 includes the whole skirt 14. The head body h1 includes the whole skirt 14. The head body h1 includes a part of the crown 6.

The whole of the head body h1 may be integrally formed. The head body h1 may be formed by joining a plurality of members.

The head body h1 has a crown opening cp1. In FIG. 3, since the crown member c1 is removed, an inner surface 8*m* of the sole 8 can be seen. In the head 2, the crown opening cp1 is closed by the crown member c1. Therefore, in the head 2, the inner surface 8*m* of the sole 8 is not visually recognized.

As shown in FIG. 3, the head body h1 includes a receipt part cp2 at a peripheral edge of the crown opening cp1. The receipt part cp2 abuts on an inner surface of the crown member c1. In the head 2, the receipt part cp2 is not visually recognized.

Figure 4:
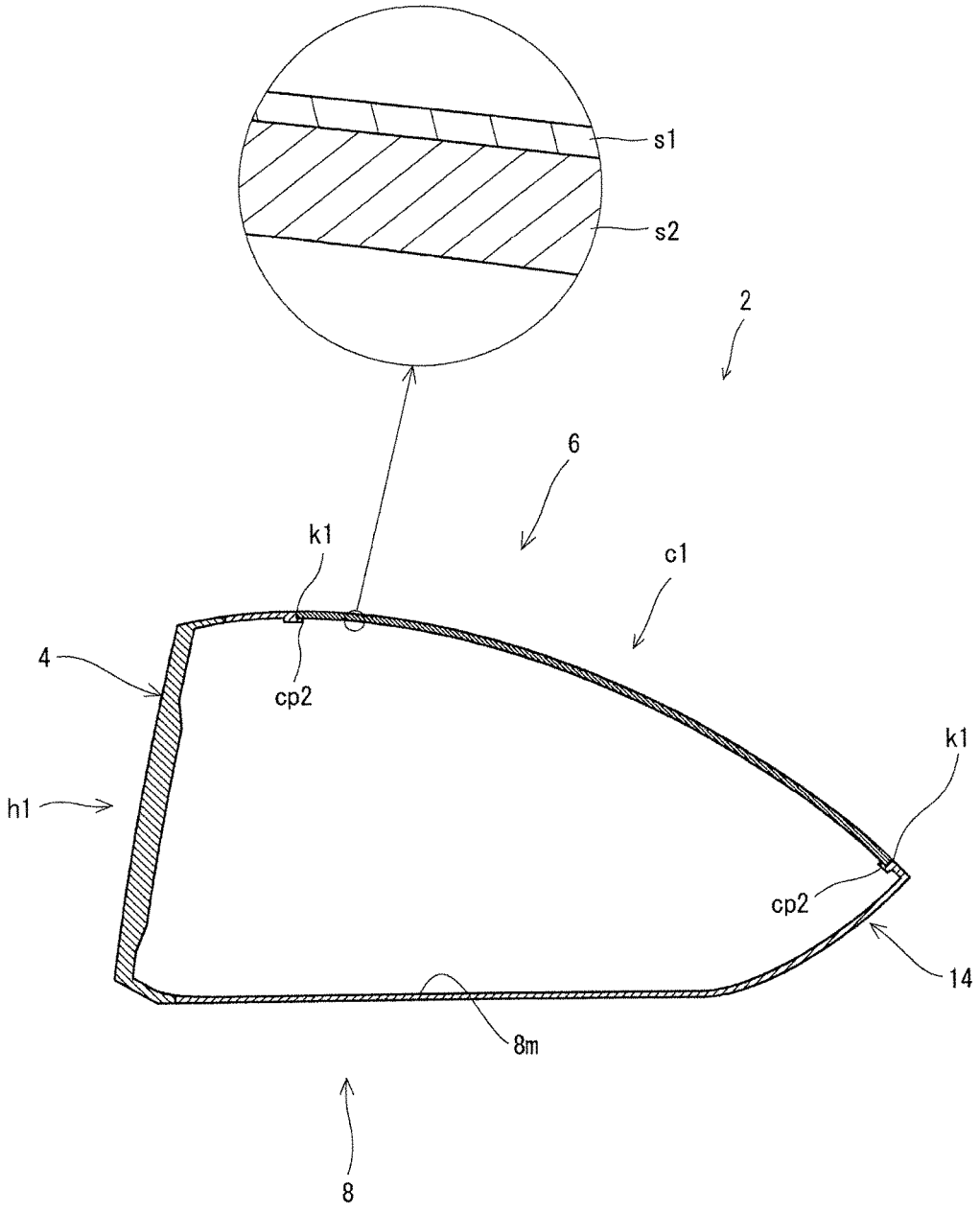
FIG. 4 shows a cross-sectional view taken along line F4-F4 in FIG. 2.

FIG. 4 is a cross-sectional view taken along line F4-F4 in FIG. 2. The receipt part cp2 supports a peripheral edge part of the crown member c1 from inside. The receipt part cp2 is overlapped with the peripheral edge part of the crown member c1. The receipt part cp2 has a step having a height of equal to the thickness of the crown member c1. Therefore, the outer surface of the head 2 does not have a step on a boundary k1 between the crown member c1 and the head body h1. As described later, the receipt part cp2 may not exist.

The crown member c1 constitutes a part of the crown 6. The crown member c1 forms a large part of the crown 6. The crown member c1 occupies 50% or more of the area of the crown 6. The crown member c1 may occupy 60% or more of the area of the crown 6. The crown member c1 may occupy 70% or more of the area of the crown 6. The crown member c1 may occupy 80% or more of the area of the crown 6. The crown member c1 may form the whole crown 6.

The method for joining the crown member c1 and the head body h1 is welding. That is, the crown member c1 is welded to the head body h1. An outer layer of the crown member c1 is welded to the head body h1. An adhesive agent is not used for the joining between the crown member c1 and the head body h1.

In the head 2, the crown member c1 is made of the clad material. As a result, in the head 2, a part of the crown 6 is formed by the clad material. The clad material may form the whole crown 6. The clad material may form at least a part of the sole 8. The clad material may form the whole sole 8. The clad material may form a part of the crown 6 and a part of the sole 8. In this case, for example, the clad material may include a portion extending from a back part of the crown 6, through a back part of the skirt 14, to a back part of the sole 8.

The clad material means a metal plate in which two or more types of metals are stacked and joined. The two or more types of metals are directly joined to each other without using an adhesive agent in the joining. In the clad material, two or more types of metals are joined by a method such as rolling, explosive cladding, or the like. A clad state is formed on each boundary surface between the different types of metals, and thus the clad state enhances joining strength at the boundary surface.

Enlarged portion in FIG. 4 is an enlarged cross-sectional view of the crown member c1 made of the clad material. The clad material has a two-layer structure. A first layer s1 is an outer layer. The first layer s1 is the outermost layer. The first layer s1 constitutes the outer surface of the head 2 (crown 6). A second layer s2 is an inner layer. The second layer s2 is the innermost layer. The second layer s2 is positioned inside the first layer s1. The second layer s2 is brought into contact with the first layer s1. The second layer s2 constitutes the inner surface of the head 2 (crown 6). The second layer s2 fronts on the hollow part.

In the present application, the term "adjacent portion" is used for the joining portion between the clad material c1 and the head body h1. The adjacent portion means a portion welded to the clad material. In other words, the adjacent portion means a portion melted in welding. Whether a portion is the adjacent portion or not can be determined by observing a cross section thereof. The adjacent portion is a part of the head body h1. In the present embodiment, the material of the adjacent portion is the same as the material of the whole head body h1.

The adjacent portion brought into contact with the peripheral edge of the clad material c1 is joined to the clad material c1. This joining is performed by welding. However, what is welded to the adjacent portion is the first layer s1 only. The second layer s2 is not welded to the adjacent portion. The meaning of the term "is not welded" includes an insufficient welding (for example, in the case where a vulnerable intermetallic compound is produced). As described later, since the second layer s2 does not have an affinity for welding with the adjacent portion, welding between the adjacent portion and the second layer s2 will be insufficient even if they are welded.

The first layer s1 has an affinity for welding with the adjacent portion. Therefore, the first layer s1 is welded to the adjacent portion. On the other hand, the second layer s2 does not have an affinity for welding with the adjacent portion.

The "affinity for welding" is a term uniquely defined in the present application, and serves as an index for weldability. The affinity for welding is determined by comparing materials of both members welded to each other. When the principal components of the members are common, it is defined that the members have the affinity for welding with each other. The principal component means a component the content of which is equal to or greater than 50% by weight. On the other hand, when the members do not have a common principal component, it is defined that the members do not have the affinity for welding with each other. It goes without saying that the principal component is a metal.

The second layer s2 need not have the affinity for welding, and thus has a high degree of freedom for selecting the material. Therefore, for example, a material having a low specific gravity can be selected for the second layer s2. The second layer s2 having a specific gravity lower than that of the first layer s1 contributes to reduction of the weight of the clad material.

Since the degree of freedom for selecting the material of the second layer s2 is enhanced, various properties can be introduced into the clad material. For example, when a material having an excellent processability is selected for the second layer s2, the processability of the clad material can be improved. For example, when a material having a high specific gravity is selected for the second layer s2, the specific gravity of the clad material can be enhanced.

As described above, the head 2 includes a hollow part (see FIG. 4). The second layer s2 fronts on the hollow part. The boundary between the first layer s1 and the adjacent portion is heated in welding. Welding between the first layer s1 and the adjacent portion is achieved by the heat. Meanwhile, the heat is conveyed to the second layer s2. Since the second layer s2 does not have the affinity for welding with the adjacent portion, the second layer s2 may not be heated. This is because the welding between the second layer s2 and the adjacent portion is insufficient, as described above. However, the heat is inevitably conveyed to the second layer s2. The heat is also conveyed to the boundary surface between the first layer s1 and the second layer s2.

In the clad material, the first layer s1 and the second layer s2 are metallurgically joined, and the clad state is formed at the boundary surface. The first layer s1 and the second layer s2 are firmly joined to each other by the clad state. The clad state might be changed by heating the boundary surface between the first layer s1 and the second layer s2. This change might reduce the joining strength between the first layer s1 and the second layer s2. If the joining strength between the layers is reduced, the strength of the clad material c1 can be reduced.

In the head 2, the second layer s2 fronts on the hollow part. The second layer s2 is subjected to air cooling by the hollow part. The air cooling suppresses rising of the temperature of the boundary surface between the first layer s1 and the second layer s2. As a result, the change of the clad state is suppressed and thus the strength of the clad material c1 is maintained as high as it is. Thus, because of the air-cooling effect, the second layer s2 fronting on the hollow part enhances the joining strength of the welding.

The second layer s2 fronts on the hollow part. The insufficient welding portion between the second layer s2 and the adjacent portion is not exposed to outside, and thus is not seen from outside. Therefore, the external appearance of the head 2 can be improved.

A small width is enough for the receipt part cp2 because the joining method is welding, not adhesion. The receipt part cp2 is provided merely for positioning of welding. An overlapping width of the receipt part cp2 and the clad material c1 can be set to, for example, equal to or less than 4 mm, more preferably equal to or less than 3 mm, still more preferably equal to or less than 2 mm, and yet still more preferably equal to or less than 1 mm. In the head 2 including a small-width receipt part cp2, the weight of the joining portion is suppressed. As described later, the receipt part cp2 may not exist. In other words, the overlapping width of the receipt part cp2 and the clad material c1 may be 0 mm.

Figure 5:
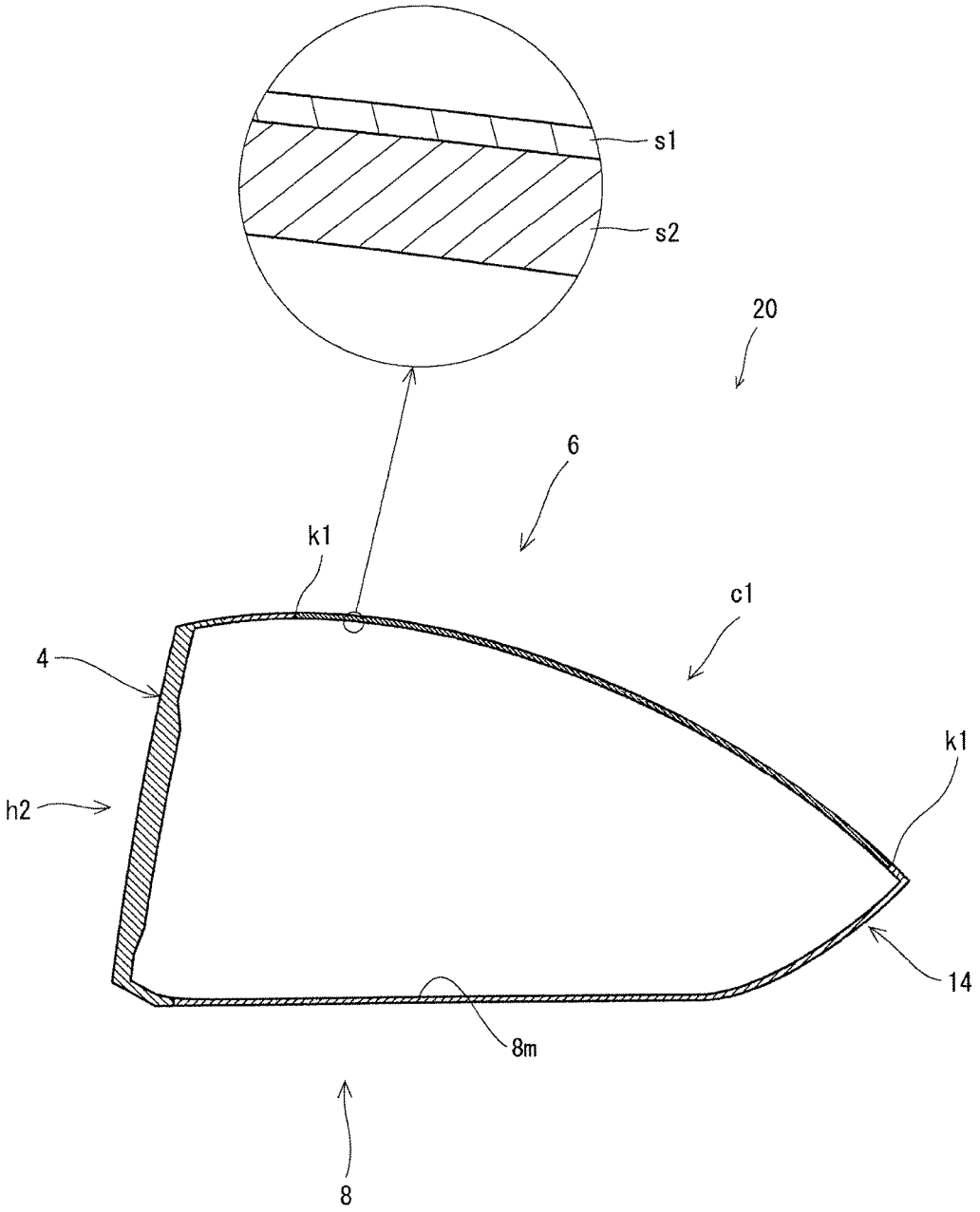
FIG. 5 shows a cross-sectional view of a head according to a second embodiment.

FIG. 5 is a cross-sectional view of a head 20 according to a second embodiment. Unlike the above described head 2, the head 20 includes a head body h2 not having the receipt part cp2. The difference between the head 20 and the head 2 is only whether or not the receipt part cp2 exists. The clad material c1 and the adjacent portion (head body h2) are joined in a state where they butt against each other. Since welding for the clad material can be performed by such a way, the receipt part cp2 can be omitted.

Figure 6:
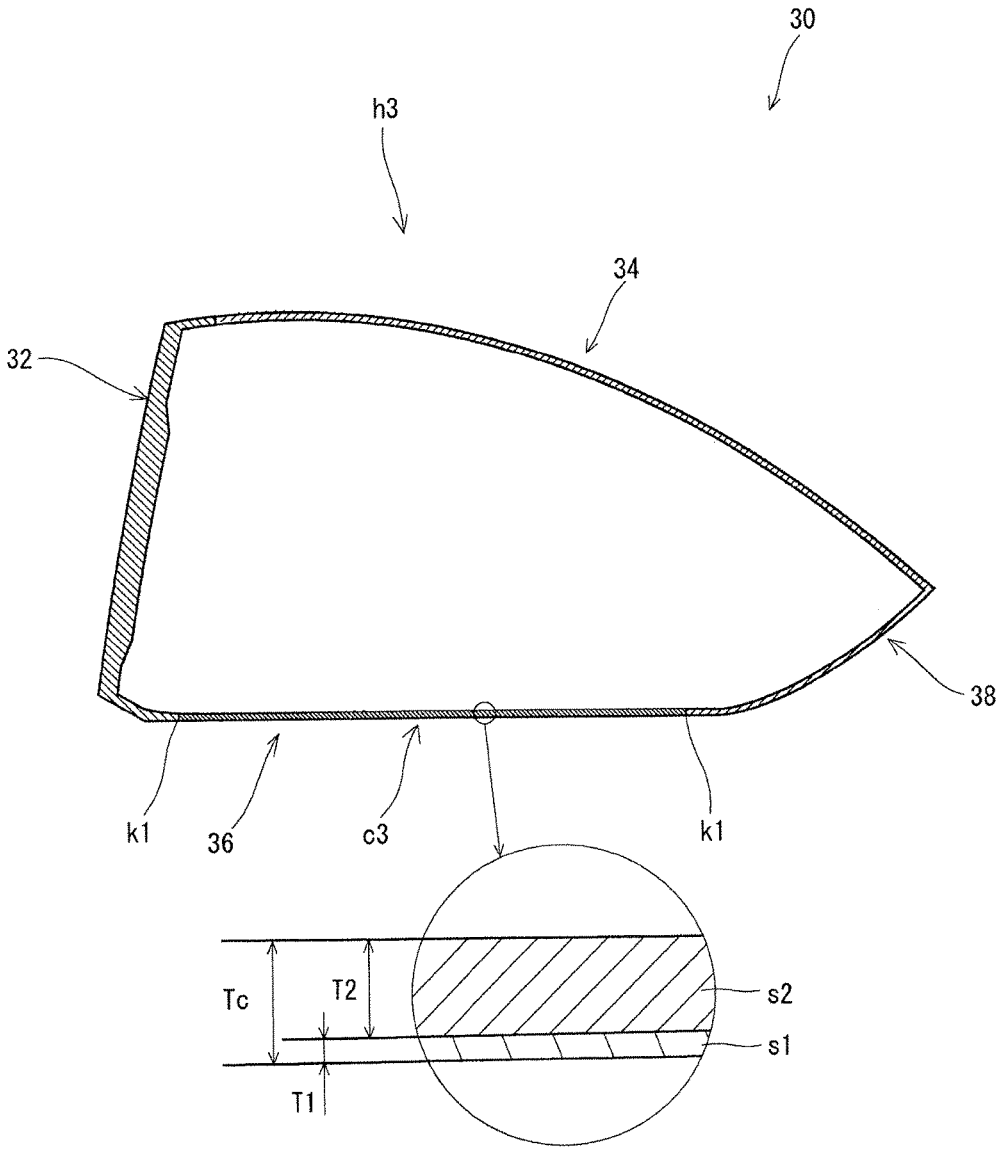
FIG. 6 shows a cross-sectional view of a head according to a third embodiment.

FIG. 6 is a cross-sectional view of a head 30 according to a third embodiment. The head 30 is a wood-type head. The head 30 includes a face 32, a crown 34, a sole 36, and a hosel. Inside of the head 30 is hollow. That is, the head 30 includes a hollow part. The head 30 further includes a skirt 38.

The head 30 is formed by joining a plurality of members. In the head 30 of the present embodiment, a sole member c3 is joined to a head body h3. On an outer surface of the head 30, there is no step at a boundary k1 between the sole member c3 and the head body h3.

The head body h3 includes the whole face 32. The head body h3 includes a part of the sole 36. The head body h3 includes the whole skirt 38. The head body h3 includes the whole crown 34.

The head body h3 has a sole opening cp3. The sole opening cp3 is closed by the sole member c3.

The sole member c3 constitutes a part of the sole 36. The sole member c3 forms a large part of the sole 36. The sole member c3 occupies 50% or more of the area of the sole 36. The sole member c3 may form the whole sole 36.

In the head 30, the sole member c3 is made of the clad material. In the head 30, a part of the sole 36 is formed by the clad material.

Enlarged portion in FIG. 6 is an enlarged cross-sectional view of the sole member c3 made of the clad material. This clad material has a two-layer structure. A first layer s1 is an outer layer. The first layer s1 is the outermost layer. The first layer s1 constitutes the outer surface of the head 30 (sole 36). A second layer s2 is positioned inside the first layer s1. The second layer s2 is brought into contact with the first layer s1. The second layer s2 is an inner layer. The second layer s2 is the innermost layer. The second layer s2 constitutes the inner surface of the head 30 (sole 36). The second layer s2 fronts on the hollow part.

The head body h3 includes an adjacent portion. The adjacent portion means a portion welded to the clad material c3. The adjacent portion is a part of the head body h3. In the present embodiment, the material of the adjacent portion is the same as the material of the whole head body h3.

The adjacent portion is joined to the clad material c3. The joining is performed by welding. However, what is joined to the adjacent portion is the first layer s1 only. The first layer s1 has the affinity for welding with the adjacent portion. Therefore, the first layer s1 is welded to the adjacent portion. On the other hand, the second layer s2 does not have the affinity for welding with the adjacent portion.

Thus, in the head 30, at least a part of the sole 36 is formed by the clad material c3. In the clad material c3, the second layer s2 may have a specific gravity greater than the specific gravity of the first layer s1. In this case, a center of gravity of the head 30 can be lowered. In the clad material c3, for example, the material of the first layer s1 is set to a titanium-based alloy and the material of the second layer s2 is set to a stainless steel. In this case, as compared with the case where the same weight of a titanium-based alloy is used, the thickness of the clad material is suppressed and lowering of the center of gravity of the head can be promoted.

Also in the head 30, the second layer s2 fronts on the hollow part. The strength of the clad material can be maintained as high as it is because of air-cooling effect brought by the hollow part.

Figure 7:
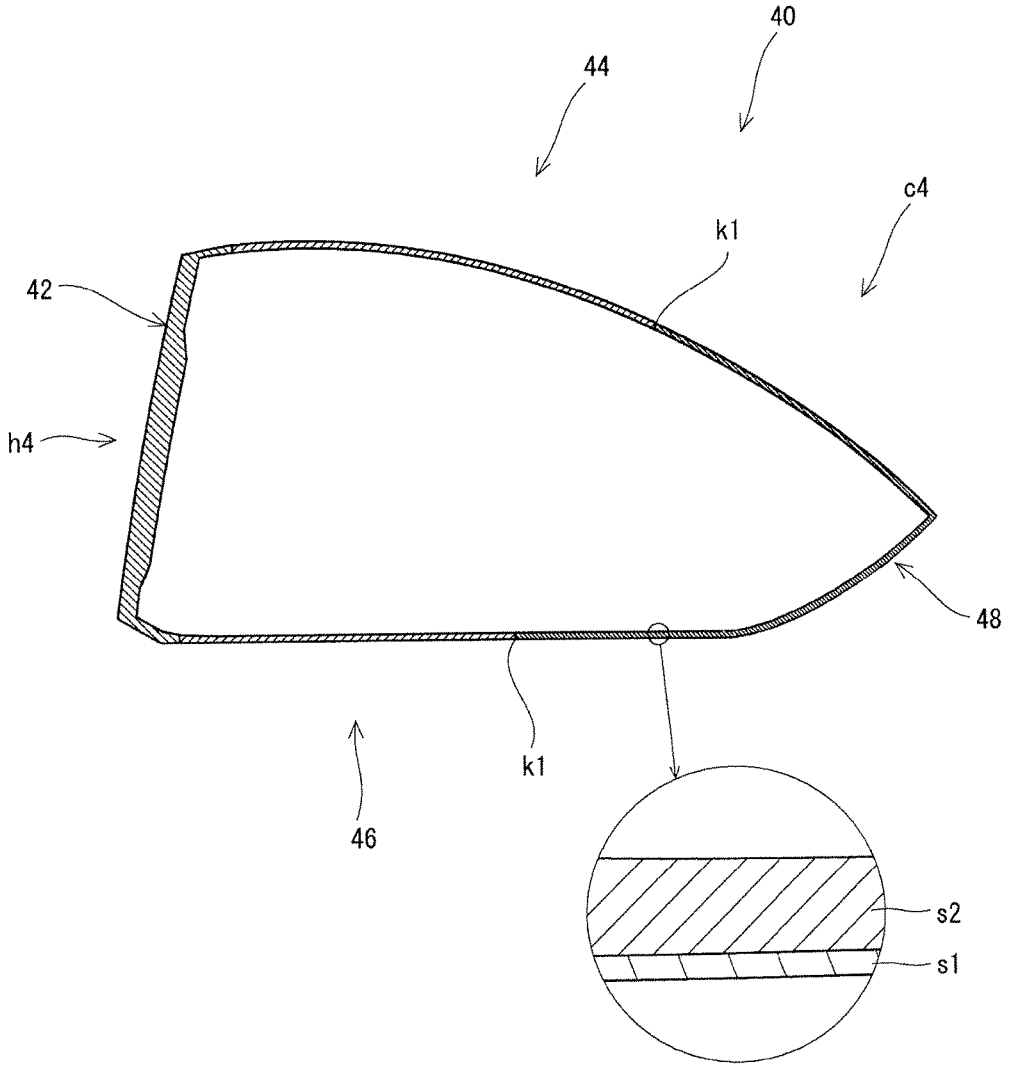
FIG. 7 shows a cross-sectional view of a head according to a fourth embodiment.

FIG. 7 is a cross-sectional view of a head 40 according to a fourth embodiment. The head 40 is a wood-type head. The head 40 includes a face 42, a crown 44, a sole 46 and a hosel. Inside of the head 40 is hollow. That is, the head 40 has a hollow part. The head 40 further includes a skirt 48.

The head 40 is formed by joining a plurality of members. In the head 40 of the present embodiment, a back member c4 is joined to a head body h4. On the outer surface of the head 40, there is no step at a boundary k1 between the back member c4 and the head body h4.

The head body h4 includes the whole face 42. The head body h4 includes a part of the sole 46. The head body h4 includes a part of the skirt 48. The head body h4 includes a part of the crown 44.

The head body h4 includes an opening at a back side thereof. The opening extends from a back side of the crown 44 to a back side of the sole 46. The opening is closed by the back member c4.

The back member c4 constitutes a part of the crown 44. The back member c4 constitutes a part of the sole 46. The back member c4 constitutes a part of the skirt 48.

In the head 40, the back member c4 is made of the clad material. In the head 40, a part of the crown 44, a part of the sole 46, and a part of the skirt 48 are formed by the clad material. When the clad material has a small specific gravity, the back member c4 is lightweight. The lightweight back member c4 contributes to positioning the center of gravity of the head forward (closer to the face). When the clad material has a great specific gravity, the back member c4 is heavyweight. The heavyweight back member c4 contributes to positioning the center of gravity of the head backward.

Figure 8:
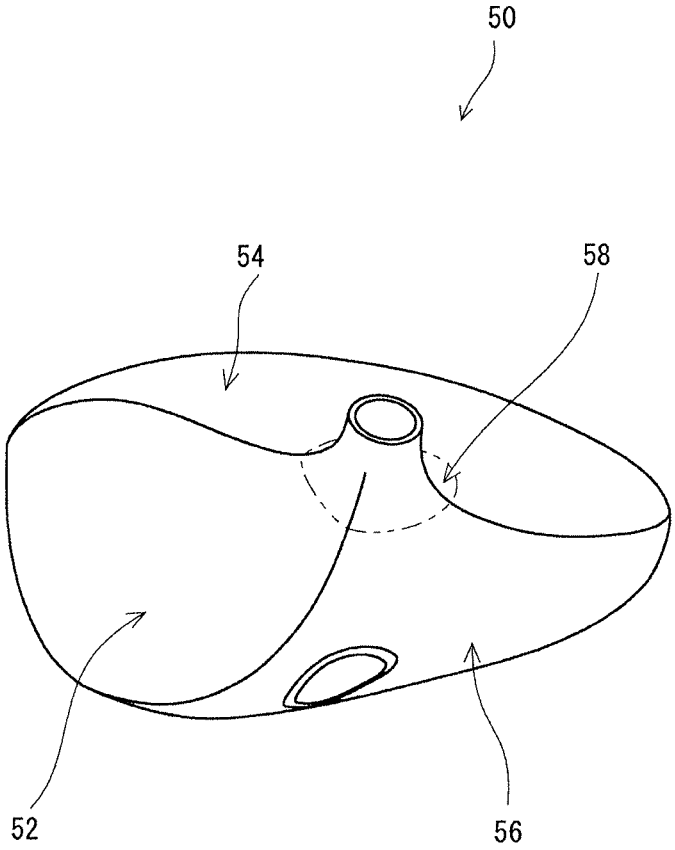
FIG. 8 shows a perspective view of a head according to a fifth embodiment.
Figure 9:
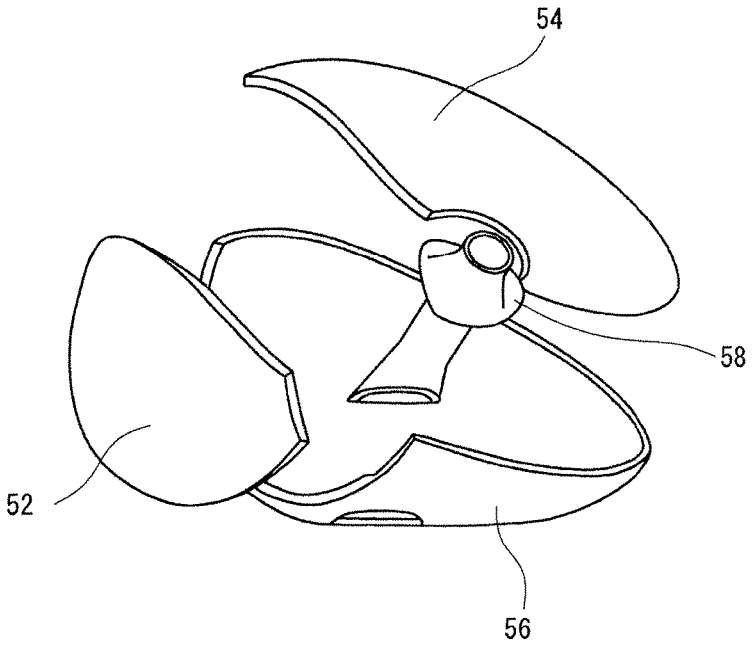
FIG. 9 shows an exploded perspective view of the head in FIG. 8.

FIG. 8 is a perspective view of a head 50 according to a fifth embodiment. FIG. 9 is an exploded perspective view of the head 50.

The head 50 has a four-piece structure. The head 50 includes a face member 52, a crown member 54, a sole member 56 and a hosel member 58. In the head 50, these four members 52, 54, 56 and 58 are joined to one another.

The clad material is adopted for at least one of these four members. For example, the crown member 54 may be made of the clad material. For example, the sole member 56 may be made of the clad material. For example, the crown member 54 and the sole member 56 may be made of the clad material. The clad material has a plural-layer structure. The material of a first layer of the clad material is a titanium alloy, and the first layer is the outermost layer. The material of a portion which is not the clad material can be a titanium alloy. In this case, the member made of the clad material and the other member can be welded to each other. In the head 50, joining between all of the members can be welding. Welding between the clad material and another member is butt welding. The weight of the joined portion is suppressed by adopting the butt welding. By adopting the welding, not adhesion, the head 50 has an excellent durability.

Figure 10A:
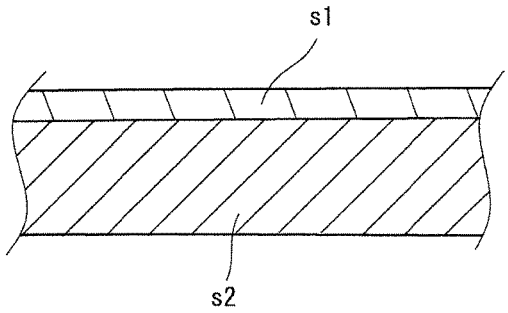
FIG. 10A shows a cross-sectional view illustrating an example of a clad material having a two-layer structure.
Figure 10B:
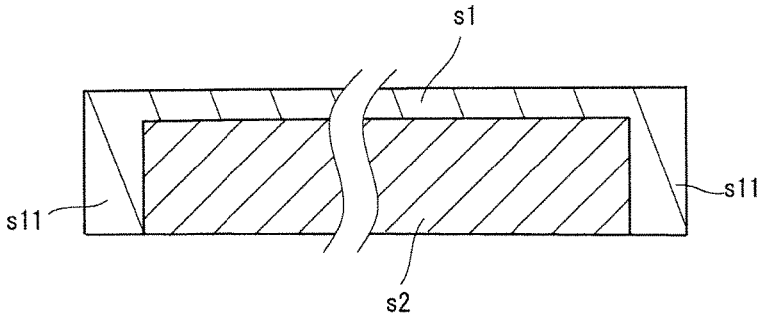
FIG. 10B shows a cross-sectional view illustrating another example of the clad material having a two-layer structure.

FIG. 10A is a cross-sectional view of the clad material having the above described two-layer structure. FIG. 10B shows an embodiment in which each side surface of the second layer s2 is covered by an edge layer s11. The material of the edge layer s11 is the same as the material of the first layer s1. The edge layer s11 is continuous to the first layer s1. The edge layer s11 extends from the end of the first layer s1 so as to cover the side surface of the second layer s2. Like the first layer s1, the edge layer s11 has the affinity for welding with the adjacent portion. Thus, the edge layer s11 is welded to the adjacent portion. The edge layer s11 can enlarge a contact area having the affinity for welding. Therefore, welding strength can be improved. Method for forming the edge layer s11 is not limited. Examples of the method include welding, vapor deposition, thermal spraying, building up, and the like.

The number of layers of the clad material is not limited. For example, the clad material may be formed by three layers.

Figure 10C:
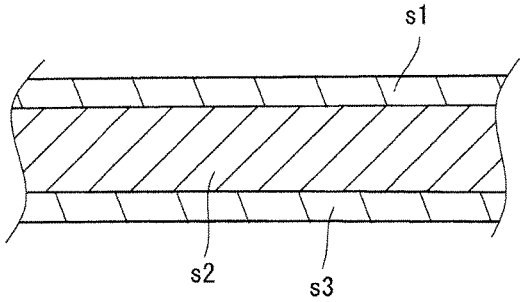
FIG. 10C shows a cross-sectional view illustrating an example of a clad material having a three-layer structure.

FIG. 10C is a cross-sectional view showing an example of the clad material having a three-layer structure. The clad material in FIG. 10C includes a first layer s1, a second layer s2 and a third layer s3. The second layer s2 is positioned between the first layer s1 and the third layer s3. The second layer s2 is sandwiched between the first layer s1 and the third layer s3. The material of the third layer s3 may be the same as the material of the first layer s1. The first layer s1 and the third layer s3 may have the affinity for welding with the adjacent portion, and the second layer s2 may not have the affinity for welding with the adjacent portion.

[First Layer s1 (Outer Layer) of Clad Material]

The first layer s1 is an outer layer (outermost layer). The first layer s1 constitutes the outer surface of the head. Examples of the material of the first layer s1 (outer layer) include an iron-based alloy, a titanium-based alloy, a pure titanium, an aluminum-based alloy, a pure aluminum, a magnesium-based alloy, a pure magnesium, a copper-based alloy, a pure nickel, a nickel-based alloy, and a zinc-based alloy.

The iron-based alloy means an alloy containing iron as the principal component, and the same rule holds true for other types of alloys. The principal component means a component the content of which is equal to or greater than 50% by weight.

Examples of the iron-based alloy include a steel and a cast iron. Examples of the steel include a carbon steel, a high-tensile steel, a tool steel, a carbon tool steel, an alloy tool steel, a high speed steel, a cutting steel, a cast steel, a stainless steel, an electromagnetic steel, a silicon steel, a KS steel, a MK steel, a maraging steel, a Krupp steel, a chromium steel, a nickel-chromium steel, a vanadium steel, a chromium molybdenum steel, a manganese steel, a manganese molybdenum steel, and a Yasuki steel. Examples of the carbon steel include S25C. Examples of the stainless steel include SUS304 and SUS430.

Examples of the titanium-based alloy include an α-titanium, an αβ-titanium, and a β-titanium. Examples of the α-titanium, include Ti-5Al-2.5Sn and Ti-8Al-1V-1Mo. Examples of the αβ-titanium include Ti-6Al-4V, Ti-6Al-2Sn-4Zr-6Mo, Ti-4.5Al-3V-2Fe-2Mo and Ti-6Al-6V-2Sn. Examples of the p-titanium include Ti-15V-3Cr-3Sn-3Al, Ti-20V-4Al-1Sn, Ti-22V-4Al, Ti-15Mo-2.7Nb-3Al-0.2Si and Ti-16V-4Sn-3Al-3Nb.

As the pure titanium, an industrial pure titanium is exemplified. As the industrial pure titanium, type 1 pure titanium, type 2 pure titanium, type 3 pure titanium, and type 4 pure titanium, which are defined by Japanese Industrial Standards, are exemplified.

Examples of the aluminum-based alloy include 2000 series, 3000 series, 4000 series, 5000 series, 6000 series, 7000 series, and 8000 series, which are indicated by four-digit numbers given as the international aluminum alloy designation. 1000 series are pure aluminums. The 2000 series are Al—Cu-based alloy, and include duralumin (2017) and super duralumin (2024). The 3000 series are Al—Mn-based alloy. The 4000 series are Al—Si-based alloy. The 5000 series are Al—Mg-based alloy. The 6000 series are Al—Mg—Si-based alloy. The 7000 series are Al—Zn—Mg-based alloy and Al—Zn—Mg—Cu-based alloy, and are excellent in strength. The 7000 series include extra-super duralumin (7075) and 7N01.

Examples of the magnesium-based alloy include AZ31, AM60, AZ61, AZ80 and AZ91. These names are defined by ASTM.

Examples of the copper-based alloy include brass, bronze, cupronickel, gold bronze, nickel silver, red brass, copper-chromium alloy, beryllium bronze, aluminum bronze, and phosphor bronze.

In view of strength and lightweightness of the head, the material of the head body is preferably a titanium-based alloy. Therefore, the material of the adjacent portion, which is a part of the head body, is preferably a titanium alloy. In light of enhancing welding strength between the adjacent portion and the clad material, the first layer of the clad material is preferably made of a titanium-based alloy.

[Second Layer s2 (Inner Layer) of the Clad Material]

The second layer s2 of the clad material is positioned inside the first layer s1. Examples of the material of the second layer s2 include an iron-based alloy, a titanium-based alloy, a pure titanium, an aluminum-based alloy, a pure aluminum, a pure magnesium, a magnesium-based alloy, a copper-based alloy, a pure nickel, a nickel-based alloy, and a zinc-based alloy. All of materials which can be used for the first layer s1 can also be used for the second layer s2. Examples of respective alloys are as mentioned above.

The material of the second layer s2 is different from the material of the first layer s1. As to this term "different", in the present application, the materials are considered as different from each other as long as ratios of all of components of those are not the same. The materials are considered as the "same", only when ratios of all of components of those are the same.

In light of weight reduction of the clad material, the second layer s2 is preferably made of an aluminum-based alloy or a magnesium-based alloy, and more preferably made of magnesium-based alloy. In light of attaining a balance between lightweightness and strength, an aluminum-based alloy is more preferable.

The second layer s2 is positioned inside the first layer s1. The second layer s2 is bought into contact with the first layer s1. When the clad material has two layers, the second layer s2 preferably fronts on the hollow part of the head.

As shown in FIG. 100, the clad material may have three layers. The clad material includes an outermost layer, a middle layer, and an innermost layer. The outermost layer constitutes the surface of the head. The middle layer is positioned between the outermost layer and the innermost layer. Preferably, the inner most layer fronts on the hollow part of the head. The outermost layer is the first layer s1, and a material thereof is as described above. The middle layer is the second layer s2, and a material thereof is as described above. The innermost layer is the third layer s3, and a material thereof, for example, can be the same as the material of the first layer s1.

The clad material may have four or more layers. The outermost layer of the clad material is the first layer, and a material thereof is as described above. The material of the innermost layer of the clad material can be the same as the material of the first layer.

In the clad material having three or more layers, materials of layers adjacent to each other are different from each other. In the clad material having three or more layers, materials of layers which are not adjacent to each other may be the same, or may be different from each other.

[Thickness T1 of the First Layer]

Double-headed arrow T1 in FIG. 6 shows a thickness of the first layer s1. In view of welding strength, the thickness T1 of the first layer s1 is preferably equal to or greater than 0.1 mm, more preferably equal to or greater than 0.12 mm, and still more preferably equal to or greater than 0.15 mm. In view of weight reduction of the clad material, the thickness T1 is preferably equal to or less than 0.45 mm, more preferably equal to or less than 0.4 mm, still more preferably equal to or less than 0.38 mm, and yet still more preferably equal to or less than 0.35 mm. These numerical ranges are preferable, in particular, when the clad material constitutes the crown.

[Thickness T2 of the Second Layer]

Double-headed arrow T2 in FIG. 6 shows a thickness of the second layer s2. By increasing the proportion of the second layer s2 in the clad material, an effect based on the property of the second layer s2 is further enhanced. In this respect, the thickness T2 of the second layer s2 is preferably equal to or greater than 0.35 mm, more preferably equal to or greater than 0.4 mm, still more preferably equal to or greater than 0.42 mm, and yet still more preferably equal to or greater than 0.45 mm. In light of adjusting a thickness Tc of the clad material to a preferably value, the thickness T2 is preferably equal to or less than 0.7 mm, more preferably equal to or less than 0.6 mm, still more preferably equal to or less than 0.58 mm, and yet still more preferably equal to or less than 0.55 mm. These numerical ranges are preferable, in particular, when the clad material constitutes the crown.

In light of exploiting the property of the second layer s2, T1/T2 is preferably equal to or less than 1, more preferably less than 1, still more preferably equal to or less than ½, and yet still more preferably equal to or less than ⅓. In view of welding strength, T1/T2 is preferably equal to or greater than ¼.

As described above, the degree of freedom for selecting the material of the second layer s2 is high. Therefore, the effect based on the property of the second layer s2 is various. In light of enhancing this effect, the thickness T2 of the second layer s2 is preferably greater than the thickness T1 of the first layer s1. In other words, the thickness T1 is preferably smaller than the thickness T2.

[Thickness Tc of the Clad Material]

In light of weight reduction, the thickness Tc of the clad material is preferably equal to or less than 0.8 mm, more preferably equal to or less than 0.78 mm, and still more preferably equal to or less than 0.75 mm. In light of strength, the thickness Tc is preferably equal to or greater than 0.5 mm, more preferably equal to or greater than 0.52 mm, and still more preferably equal to or greater than 0.55 mm. These numerical ranges are preferable, in particular, the clad material constitutes the crown.

An example of excellent properties of the clad material is a low specific gravity. This low specific gravity contributes to weight reduction of the clad material. The lightweight clad material enhances the degree of freedom for design of the center of gravity of the head. In this respect, the specific gravity of the second layer s2 may be smaller than the specific gravity of the first layer s1. Since degree of freedom for selecting the material of the second layer s2 is high, degree of freedom for the specific gravity of the second layer s2 is also high. The second layer s2 having a low specific gravity results in reduction of weight of the clad material. In addition, the existence of the first layer s1 secures the affinity for welding. For example, the center of gravity of the head can be lowered, if at least a part of the crown is formed by a lightweight clad material. For example, the center of gravity of the head can be positioned forward, if the back member c4 in the embodiment of FIG. 7 is lightened.

For example, when the first layer s1 is made of a titanium-based alloy, in view of weight reduction of the clad material, the specific gravity of the clad material is preferably equal to or less than 4.0, more preferably equal to or less than 3.5, still more preferably equal to or less than 3.3, still more preferably equal to or less than 3.1, still more preferably equal to or less than 3.0, still more preferably less than 3.0, still more preferably equal to or less than 2.9, and yet still more preferably equal to or less than 2.8. In view of the material of the first layer, the specific gravity of the clad material may be equal to or greater than 2.0.

In view of the affinity for welding, the specific gravity of the first layer s1 is preferably equal to or greater than 3.5, more preferably equal to or greater than 3.7, and still more preferably equal to or greater than 3.9. In light of weight reduction, the specific gravity of the first layer s1 is preferably equal to or less than 5.0.

In light of weight reduction, the specific gravity of the second layer s2 is preferably less than 3.5, more preferably equal to or less than 3.3, still more preferably equal to or less than 3.1, still more preferably equal to or less than 2.9, still more preferably equal to or less than 2.7, still more preferably equal to or less than 2.5, still more preferably equal to or less than 2.3, still more preferably equal to or less than 2.1, and yet still more preferably equal to or less than 1.9. The specific gravity of the second layer s2 may be equal to or greater than 1.6.

EXAMPLES

Hereinafter, the effects of the present invention will be clarified by examples. However, the present invention should not be interpreted in a limited way based on the description of examples.

Example 1

A cast member which includes a crown and an opening for a face and which is made of a titanium alloy (Ti-6Al-4V) was obtained. In addition, a face plate was obtained by pressing a rolled material made of a titanium alloy (Ti-15V-3Cr-3Sn-3Al). The cast member and the face plate were joined by welding to obtain a head body shown in FIG. 3.

Meanwhile, a pure aluminum (JIS A1100) member and a pure titanium (JIS type-1) member were stacked and subjected to cold rolling. Because of the cold rolling, production of an intermetallic compound at the interface is suppressed. In addition, a stabilizing treatment was performed after the rolling in order to enhance the joining strength. The stabilizing treatment was performed at a temperature of 200° C. for three hours. Thus, a clad material in which the two metals were clad was obtained. In the clad material, the thickness of the aluminum layer was 0.4 mm, and the thickness of the titanium alloy layer was 0.2 mm.

A crown member according to Example 1 was obtained by cutting the clad material into a predetermined shape and subjecting the cut clad material to press processing for imparting a three-dimensional shape of the crown. The crown member was welded to the head body. In the crown member, the first layer s1 (outer layer) was the pure titanium layer, and the second layer s2 (inner layer) was the aluminum layer. The aluminum layer fronted on the hollow part of the head. The first layer s1 (pure titanium layer) of the crown member was welded to the head body made of the titanium alloys by irradiating a laser from a head outer-surface side. When the cross section of the welded portion was observed by a microscope, it was confirmed that the welded condition was sufficient. Meanwhile, it was confirmed that welding between the second layer s2 and the head body was insufficient. The effect of heating on the boundary between the first layer s1 and the second layer s2 was concerned, but the effect was hardly observed. It is considered that this is because air cooling effect was produced by the hollow part since the second layer s2 (aluminum layer) fronted on the hollow part.

Example 2

The head body obtained in Example 1 was used. Meanwhile, a pure titanium (JIS type-1) and a magnesium alloy (AZ61) subjected to rolling treatment were prepared. The pure titanium and magnesium alloy were stacked and rolled while being heated. Temperature for the rolling was 300° C. After the rolling, homogenizing was performed in order to enhance the joining strength. The homogenizing was carried out at a temperature of 300° C. for 600 seconds in an argon atmosphere. Thus, a clad material in which the two metals were clad was obtained. In the clad material, the thickness of the magnesium alloy layer was 0.375 mm, and the thickness of the titanium layer was 0.125 mm.

A crown member according to Example 2 was obtained by cutting the clad material into a predetermined shape and subjecting the cut clad material to press processing for imparting a three-dimensional shape of the crown. The crown member was welded to the head body. In the crown member, the first layer s1 (outer layer) was the pure titanium layer, and the second layer s2 (inner layer) was the magnesium layer. The magnesium layer fronted on the hollow part of the head. The first layer s1 (pure titanium layer) of the crown member was welded to the head body made of the titanium alloys by irradiating a laser from a head outer-surface side. When the cross section of the welded portion was observed by a microscope, it was confirmed that the welded condition was sufficient. Meanwhile, it was confirmed that welding between the second layer s2 and the head body was insufficient. A bad effect on the boundary between the first layer s1 and the second layer s2 was hardly observed.

As described above, the advantages of the present invention are apparent.

The invention described above can be applied to any golf clubs.

The above description is merely for illustrative examples, and various modifications can be made without departing from the principles of the present invention.

What is claimed is:

1. A method of forming a golf club head comprising the steps of:

metallurgically joining a first layer and a second layer to form a clad material having a clad material thickness;

forming the golf club head including:

a face portion;

a crown portion extending rearwardly from an upper part of the face portion and having an opening with a receipt part at a peripheral edge, the receipt part comprising a step having a height equal to the clad material thickness; and a sole portion extending rearwardly from a lower part of the face portion, wherein at least a part of the crown portion includes a clad portion formed by the clad material, the first layer of the clad material forming at least a portion of an outer surface of the golf club head.

2. The method of claim 1, wherein the first layer and the second layer of the clad material are metallurgically joined by roll bonding.

3. The method of claim 1, wherein the first layer and the second layer of the clad material are metallurgically joined by explosive welding.

4. The method of claim 1, wherein the step of forming the club head includes closing a crown opening of the golf club head with the clad portion.

5. The method of claim 4, wherein the crown opening includes a receipt part at a peripheral edge of the crown opening.

6. The method of claim 5, wherein closing the crown opening includes abutting the receipt part to an inner surface of the clad portion.

7. The method of claim 5, wherein closing the crown opening includes overlaying the receipt part with an overlapping part of the clad portion to define an overlapping width, the overlapping width being less than or equal to 4 mm.

8. The method of claim 7, wherein the overlapping width is less than or equal to 1 mm.

9. The method of claim 5, wherein, after closing the crown opening of the golf club head with the clad portion, the receipt part is not visible.

10. The method of claim 4, wherein closing the crown opening comprises welding the first layer of the clad material in the clad portion to an adjacent portion of the crown opening.

11. The method of claim 10, wherein:

the first layer of the clad material includes a principle component, the principle component making up 50 percent or more of the first layer; and the adjacent portion of the crown opening is made of 50 percent or more of the principle component.

12. The method of claim 11, wherein the edge layer is made of the same material as the first layer and is continuous with the first layer.

13. The method of claim 11, wherein the second layer of the clad material is made of less than 50 percent of the principle component.

14. The method of claim 1, wherein forming the clad material includes covering an edge of the second layer with an edge layer.

15. The method of claim 14, wherein the third layer is made of the same material as the first layer.

16. The method of claim 1, wherein forming the clad material includes metallurgically joining a third layer to the second layer, opposite the first layer.

17. A method of forming a golf club head comprising the steps of:

metallurgically joining a first layer and a second layer to form a clad material having a clad material thickness;

forming the golf club head including:

a face portion;

a crown portion extending rearwardly from an upper part of the face portion and having an opening with a receipt part at a peripheral edge, the receipt part comprising a step having a height equal to the clad material thickness; and a sole portion extending rearwardly from a lower part of the face portion, the sole portion including a sole member formed from the clad material, the first layer of the clad material forming at least a portion of an outer surface of the sole portion.

18. The method of claim 17, wherein:

the sole portion includes a sole surface area; and the clad material first layer includes a surface area that is at least 50% of the sole surface area.

19. The method of claim 17, wherein the sole member is disposed adjacent to a rear portion of the golf club head.

20. The method of claim 17, wherein forming the golf club head includes closing a sole opening of the sole portion with the sole member by welding a portion of the first layer of the sole member to an adjacent portion of the sole opening.

* * * * *